US006711975B1

(12) United States Patent
Vollmer

(10) Patent No.: US 6,711,975 B1
(45) Date of Patent: Mar. 30, 2004

(54) FORE END WRENCH

(76) Inventor: Kraig W. Vollmer, 39428 158th St., Mellette, SD (US) 57461

( * ) Notice: Subject to any disclaimer, the term of this patent is extended or adjusted under 35 U.S.C. 154(b) by 27 days.

(21) Appl. No.: 10/171,896

(22) Filed: Jun. 14, 2002

(51) Int. Cl.[7] ..... B25B 13/48

(52) U.S. Cl. ..... 81/176.15; 81/124.2; 81/177.5; 29/263; 29/272

(58) Field of Search ..... 81/176.15, 176.2, 81/124.3, 124.7, 121.1, 119; 29/255, 263, 272, 280

(56) References Cited

U.S. PATENT DOCUMENTS

| | | | | |
|---|---|---|---|---|
| 976,391 | A | | 11/1910 | O'Hare |
| 2,403,264 | A | | 7/1946 | Cormier |
| 3,654,825 | A | | 4/1972 | Moddemeijer et al. |
| 4,210,037 | A | | 7/1980 | Taylor |
| 4,569,259 | A | * | 2/1986 | Rubin et al. ..... 81/121.1 |
| 4,676,126 | A | | 6/1987 | Polastri |
| 4,901,411 | A | | 2/1990 | Chestnut et al. |
| 6,044,732 | A | * | 4/2000 | Astle ..... 81/176.15 |
| 6,116,120 | A | | 9/2000 | Boe |
| D433,870 | S | | 11/2000 | Auclair, Jr. |
| 6,173,519 | B1 | | 1/2001 | Garrett |
| 6,230,430 | B1 | | 5/2001 | Gosselin |
| 6,374,708 | B1 | * | 4/2002 | Kunz ..... 81/124.2 |
| 2003/0079574 | A1 | * | 5/2003 | Llamas et al. ..... 81/176.15 |

* cited by examiner

*Primary Examiner*—Lee D. Wilson
(74) *Attorney, Agent, or Firm*—Kaardal & Leonard

(57) ABSTRACT

A fore end wrench for removing a locking nut from a slide action of a pump action shotgun. The fore end wrench includes a body member being designed for being inserted into the locking nut of the slide action of the shotgun. The body member is designed for supporting the locking nut of the shotgun. An engagement member extends through the body member. The engagement member is designed for engaging channels of the locking nut whereby rotation of the body member by a user rotates the engagement member against the locking nut for rotating the locking nut to remove the locking nut from the slide action to allow removal of the slide from the slide action.

20 Claims, 5 Drawing Sheets

FORE END WRENCH

BACKGROUND OF THE INVENTION

1. Field of the Invention

The present invention relates to spanner wrenches and more particularly pertains to a new fore end wrench for removing a locking nut from a slide action of a pump action shotgun.

2. Description of the Prior Art

The use of spanner wrenches is known in the prior art. U.S. Pat. No. 3,654,825 describes a device for loosening threaded protectors from a threaded body. Another type of spanner wrench is U.S. Pat. No. 6,116,120 having a tool having a pair of mounting pins for engaging a CPU fan to provide torque to the CPU fan to mount it to a mounting structure. U.S. Pat. No. 4,210,037 a spanner wrench with a pair of drive pins whereby the distance between the drive pins is adjustable. U.S. Pat. Nos. 4,901,411, 6,230,430 and 6,173,519 all have an apparatus for facilitating disassembly of a firearm. U.S. Pat. Nos. 4,676,126, 976,391 and 2,403, 264 have wrenches that are adjustable for removing a variety of spanner nuts. U.S. Pat. No. Des. 433,870 shows a home disposal de-clogger.

While these devices fulfill their respective, particular objectives and requirements, the need remains for a device that has certain improved features allowing for the adjusting of the size of the pins to accommodate differing sizes of channels in locking nuts.

SUMMARY OF THE INVENTION

The present invention meets the needs presented above by providing an engagement member and an insert member that are interchangeable to all allow the user to accommodate locking nuts having channels of varying sizes.

Still yet another object of the present invention is to provide a new fore end wrench that allows for easy replacement of the insert member and the engagement member should they become worn or damaged.

Even still another object of the present invention is to provide a new fore end wrench that allows the removal of locking nuts from a variety of makes of shotguns.

To this end, the present invention generally comprises a body member being designed for being inserted into the locking nut of the slide action of the shotgun. The body member is designed for supporting the locking nut of the shotgun. An engagement member extends through the body member. The engagement member is designed for engaging channels of the locking nut whereby rotation of the body member by a user rotates the engagement member against the locking nut for rotating the locking nut to remove the locking nut from the slide action to allow removal of the slide from the slide action.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
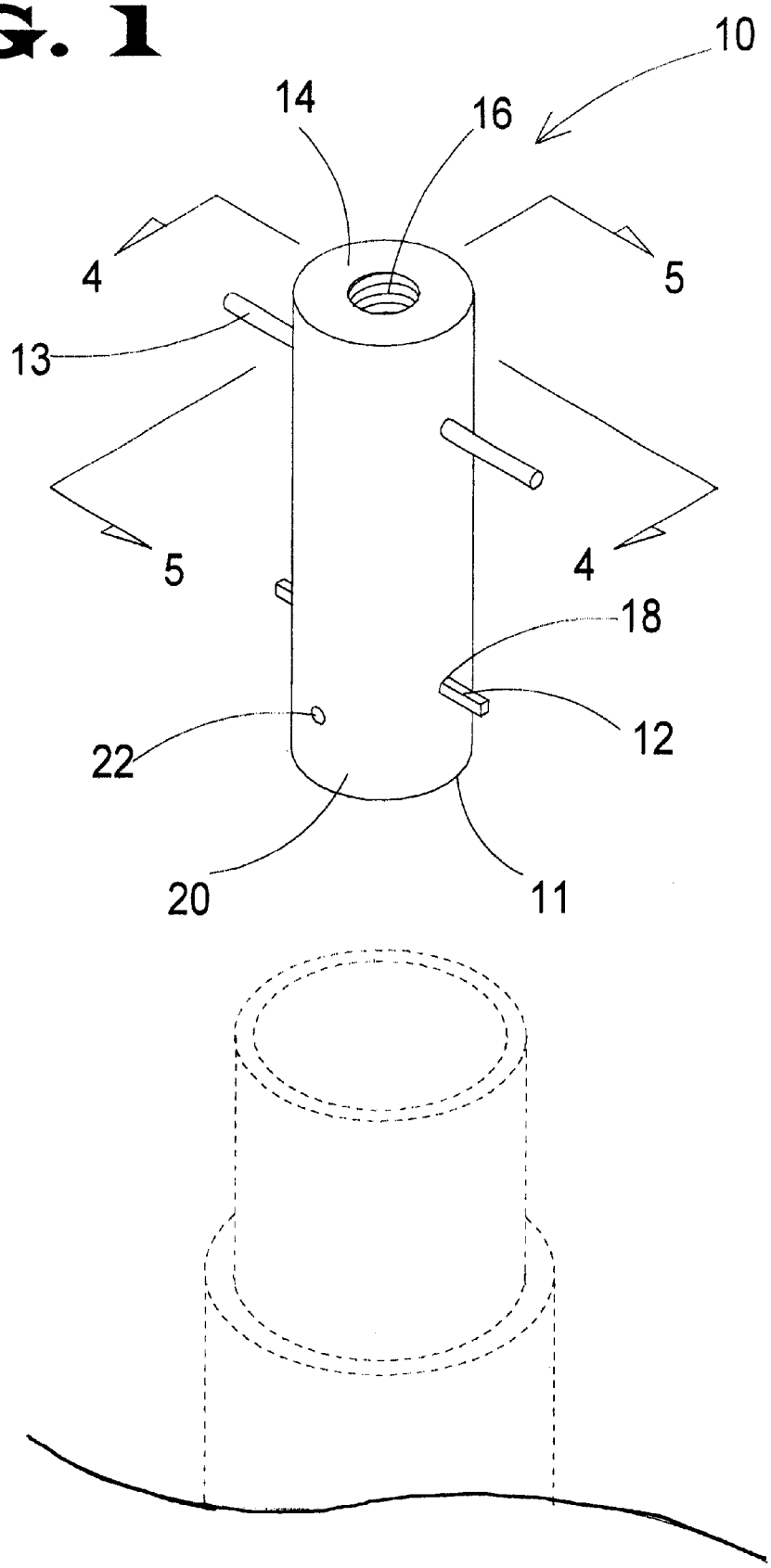
FIG. 1 is a perspective view of a new fore end wrench according to the present invention shown in use.
Figure 2:
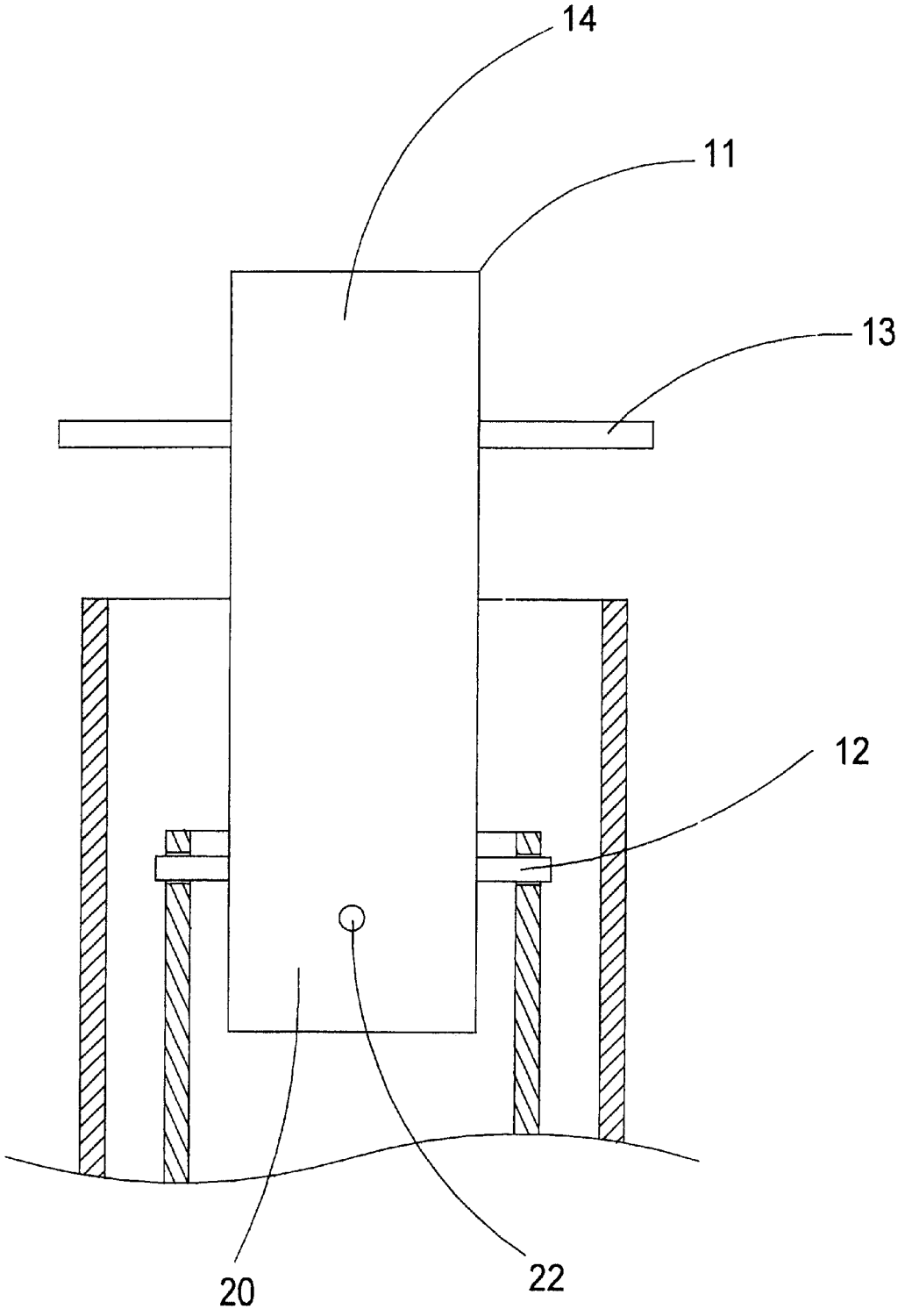
FIG. 2 is a side view of the present invention shown in use with the shotgun shown in cross-section.
Figure 3:
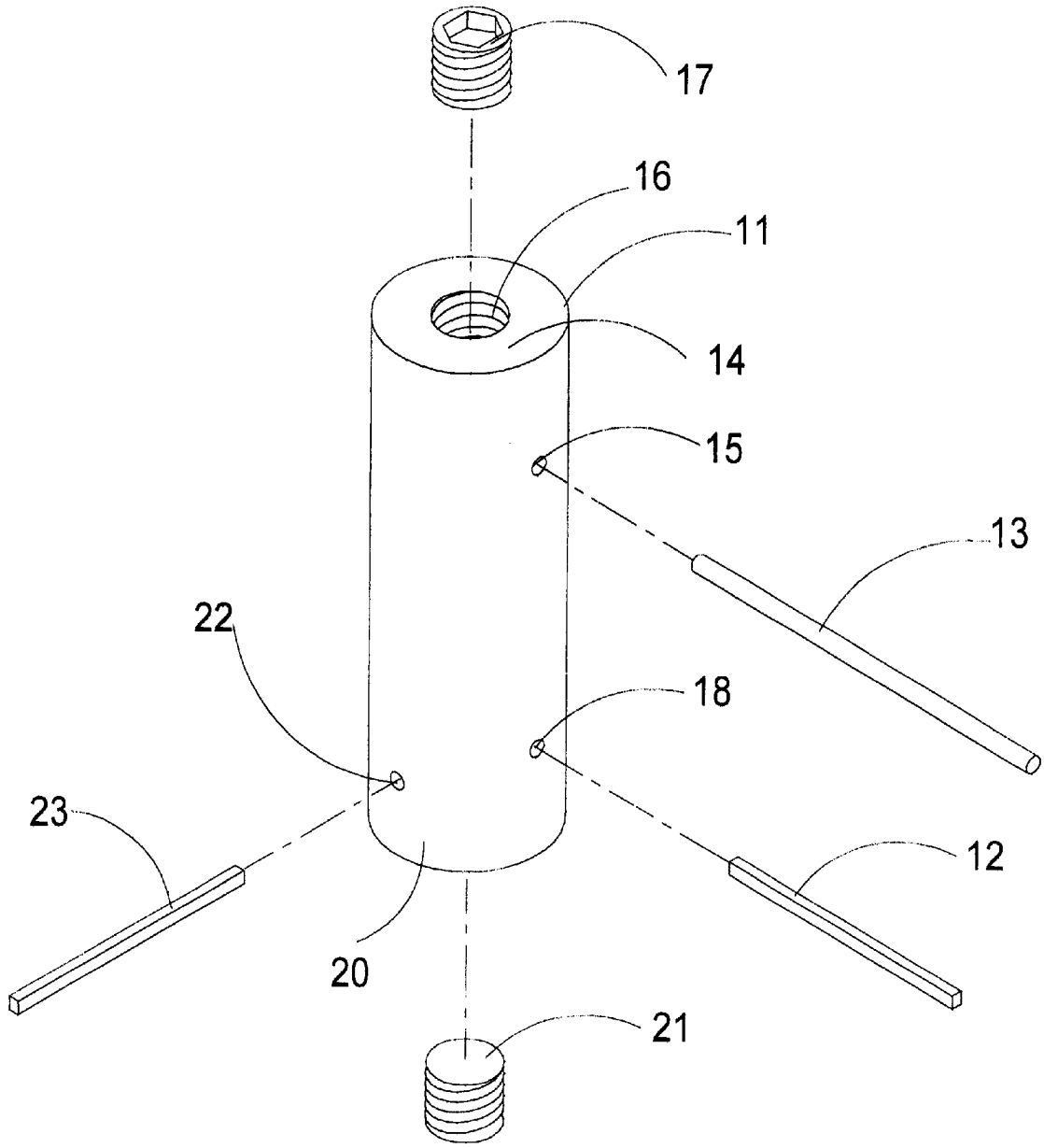
FIG. 3 is an exploded perspective view of the present invention.
Figure 4:
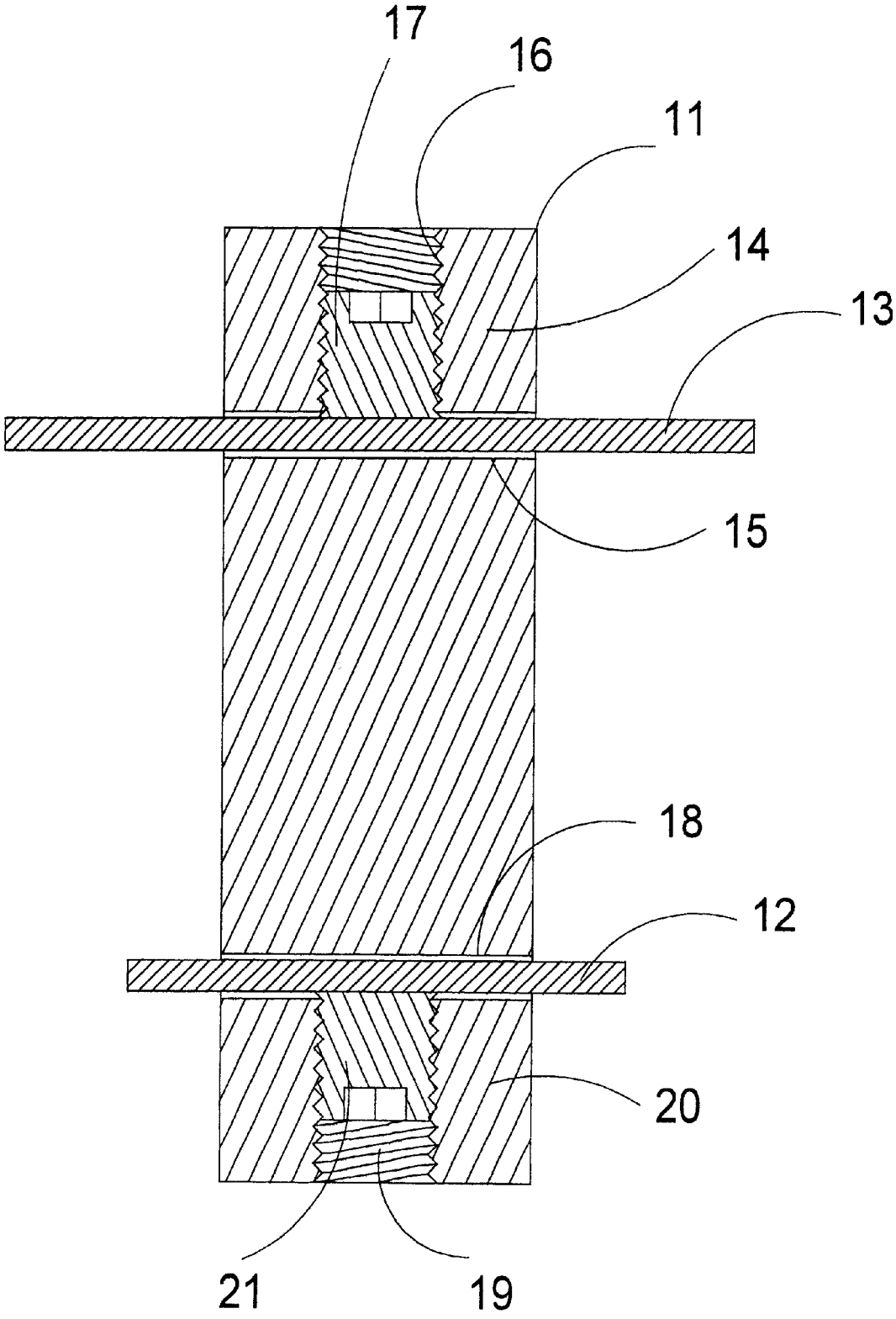
FIG. 4 is a cross-sectional view of the present invention taken along line 4—4 of FIG. 1.
Figure 5:
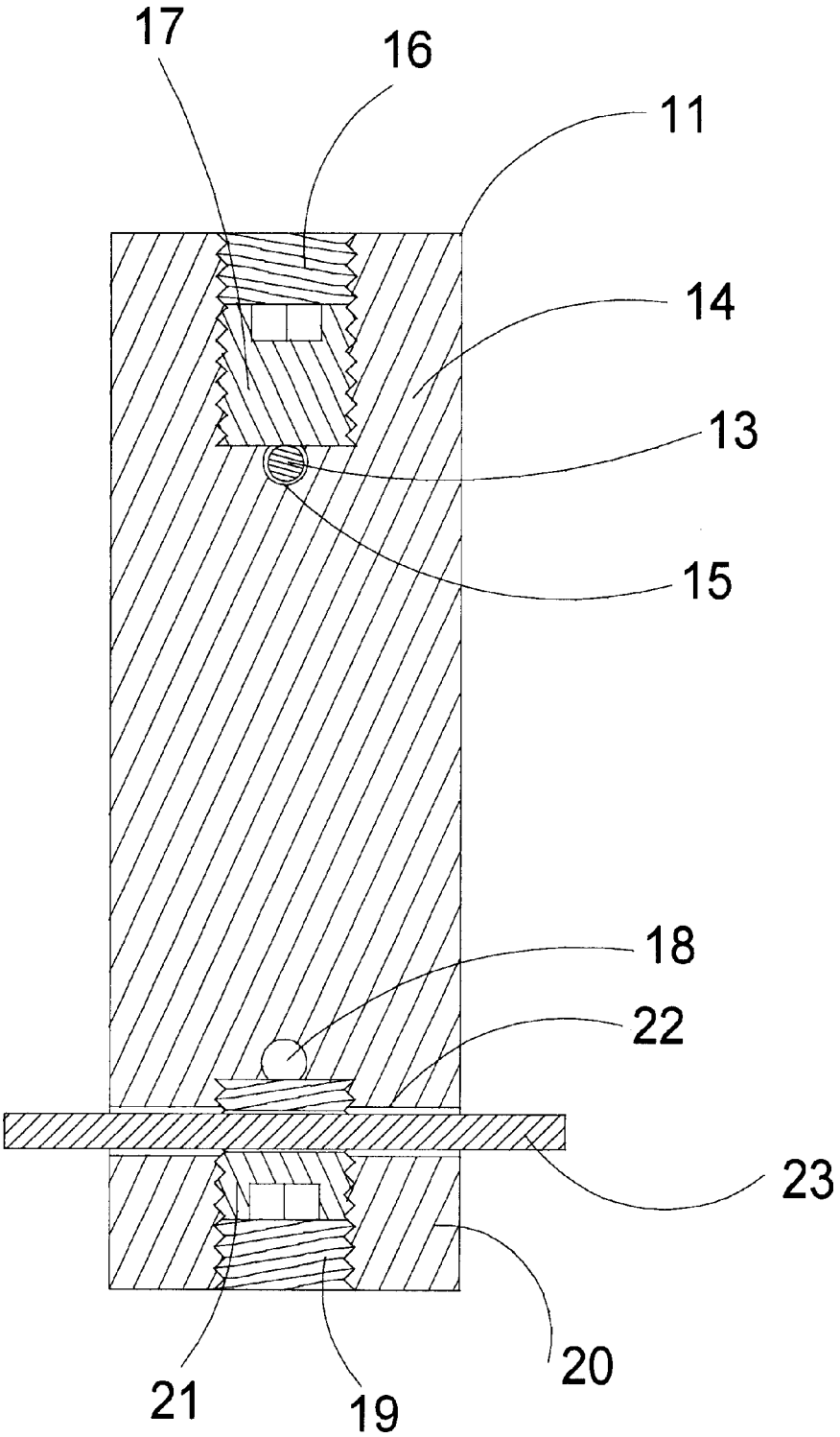
FIG. 5 is a cross-sectional view of the present invention with the engagement member removed and the insert member inserted taken along line 5—5 of FIG. 1.

With reference now to the drawings, and in particular to FIGS. 1 through 5 thereof, a new fore end wrench embodying the principles and concepts of the present invention and generally designated by the reference numeral 10 will be described.

As best illustrated in FIGS. 1 through 5, the fore end wrench 10 generally comprises a body member 11 being designed for being inserted into the locking nut of the slide action of the shotgun. The body member 11 is designed for supporting the locking nut of the shotgun. The body member 11 has a length of about 3.25 inches and a diameter of about 1 inch.

An engagement member 12 extends through the body member 11. The engagement member 12 is designed for engaging channels of the locking nut whereby rotation of the body member 11 by a user rotates the engagement member 12 against the locking nut for rotating the locking nut to remove the locking nut from the slide action to allow removal of the slide from the slide action. The engagement member 12 has length of about 1.25 inches and a width of about 3/16 of an inch.

A handle member 13 extends through the body member 11. The handle member 13 is positioned through the body member 11 proximate a first end 14 of the body member 11. The handle member 13 comprises a longitudinal axis substantially perpendicular to a longitudinal axis of the body member 11. The handle member 13 is designed for being engaged by a hand of the user for facilitating rotating of the body member 11. The handle member 13 has a length of about 4 inches and a diameter of about 0.313 on an inch.

The body member 11 comprises a handle bore 15. The handle bore has diameter of about 0.257 of an inch. The handle bore 15 extends through the body member 11. The handle bore 15 slidably receives the handle member 13 whereby the handle member 13 is selectively removable from the handle bore 15. The handle bore 15 of the body member 11 comprises a longitudinal axis substantially perpendicular to the longitudinal axis of the body member 11 whereby the handle bore 15 is for perpendicularly aligning the handle member 13 with the body member 11.

The body member 11 comprises a handle locking bore 16. The handle locking bore 16 extends into the body member 11 from the first end 14 of the body member 11 whereby the handle locking bore 16 intersects the handle bore 15.

A handle locking member 17 is threadably insertable into the handle locking bore 16 of the body member 11. The handle locking member 17 is rotatable with respect to the body member 11 for changing a linear orientation of the handle locking member 17 in the handle bore 15 of the body member 11. The handle locking member 17 selectively abuts against the handle member 13 for inhibiting removal of the handle member 13 from the handle bore 15 when the handle member 13 is positioned in the handle bore 15 of the body member 11. The handle locking member 17 selectively disengages the handle member 13 for permitting removal of the handle member 13 from the handle bore 15 of the body member 11. The handle locking bore 16 has a longitudinal axis substantially collinear with the longitudinal axis of the body member 11.

The body member 11 comprises a receiving bore 18. The receiving bore 18 extends through the body member 11. The receiving bore 18 slidably receives the engagement member 12 whereby the engagement member 12 is selectively removable from the receiving bore 18. The receiving bore 18 of the body member 11 comprises a longitudinal axis substantially perpendicular to the longitudinal axis of the body member 11 whereby the receiving bore 18 is for perpendicularly aligning-the engagement member 12 with the body member 11 for proper insertion of the engagement member 12 into the channels of the locking nut of the shotgun.

The body member 11 comprises an engagement locking bore 19. The engagement locking bore 19 extends into the body member 11 from a second end 20 of the body member 11 whereby the engagement locking bore 19 intersects the engagement bore.

An engagement locking member 21 is threadably insertable into the engagement locking bore 19 of the body member 11. The engagement locking member 21 is rotatable with respect to the body member 11 for changing a linear orientation of the engagement locking member 21 in the engagement bore of the body member 11. The engagement locking member 21 selectively abuts against the engagement member 12 for inhibiting removal of the engagement member 12 from the engagement bore when the engagement member 12 is positioned in the engagement bore of the body member 11. The engagement locking member 21 selectively disengages the engagement member 12 for permitting removal of the engagement member 12 from the engagement bore of the body member 11. The engagement locking bore 19 has a longitudinal axis substantially collinear with the longitudinal axis of the body member 11.

The body member 11 comprises an insert bore 22. The insert bore 22 has a diameter of about 0.173 of an inch. The insert bore 22 extends through the body member 11. The insert bore 22 selectively receives an insert member 23 whereby the insert member 23 is designed for being inserted into the channels of the locking nut for facilitating rotation of the locking nut when the engagement member 12 is removed from the receiving bore 18. The insert member 23 has a length of about 1.25 inches and a width of about 0.125 of an inch. The insert bore 22 of the body member 11 comprises a longitudinal axis substantially perpendicular to the longitudinal axis of the body member 11 whereby the receiving bore 18 is for perpendicularly aligning the insert member 23 with the body member 11 for proper insertion of the insert member 23 into the channels of the locking nut of the shotgun. The insert bore 22 is positioned substantially perpendicular to the receiving bore 18 for maintaining a maximum amount of material of the body member 11 between the receiving bore 18 and the insert bore 22 for inhibiting fracturing of the material of the body member 11 between the receiving bore 18 and the insert bore 22.

The engagement member 12 has a diameter greater than a diameter of the insert member 23. The insert member 23 is designed for engaging channels of a locking nut of a shotgun narrower than the diameter of the engagement member 12 for facilitating removal of the locking nut.

The insert bore 22 intersects the engagement locking bore 19. The engagement locking member 21 selectively abuts the insert member 23 for inhibiting removal of the insert member 23 from the insert bore 22 when the engagement member 12 is removed from the receiving bore 18.

In use, the user selects the insert member 23 or the engagement member 12 according to the size required for the channels of the locking nut and inserted into the associated bore in the body member 11. The engagement locking member 21 is then turned in the engagement locking bore 19 until the engagement locking member 21 either the selected engagement member 12 or the insert member 23. The user then inserts the handle member 13 into the handle bore 15 and the handle locking member 17 is rotated to engage the handle member 13 and secure the handle member 13 in the handle bore 15. The body member 11 is then inserted into the locking nut so that the selected insert member 23 or engagement member 12 engages the channels of the locking nut. The user the grips the handle member 13 and body member 11 to rotate the body member 11 and thus rotate the locking nut to remove and allow the slide of the shotgun to be removed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fore end wrench for facilitating removal of the locking nut from a slide action of a pump shotgun to allow the slide to be removed from the shotgun, the fore end wrench comprising:

a body member being adapted for being inserted into the locking nut of the slide action of the shotgun, said body member being adapted for supporting the locking nut of the shotgun;

an engagement member extending through said body member, said engagement member being adapted for engaging channels of the locking nut such that rotation of said body member by a user rotates said engagement member against the locking nut for rotating the locking nut to remove the locking nut from the slide action to allow removal of the slide from the slide action; and said body member comprising a receiving bore, said receiving bore extending through said body member, said receiving bore slidably receiving said engagement member such that said engagement member is selectively removable from said receiving bore.

2. The fore end wrench as set forth in claim 1, further comprising:

a handle member extending through said body member, said handle member being positioned through said body member proximate a first end of said body member, said handle member comprising a longitudinal axis being substantially perpendicular to a longitudinal axis of said body member, said handle member being adapted for being engaged by a hand of the user for facilitating rotating of said body member.

3. The fore end wrench as set forth in claim 2, further comprising:

said body member comprising a handle bore, said handle bore extending through said body member, said handle bore slidably receiving said handle member such that said handle member is selectively removable from said handle bore.

4. The fore end wrench as set forth in claim 3, wherein said handle bore of said body member comprises a longitudinal axis being substantially perpendicular to the longitudinal axis of said body member such that said handle bore is for perpendicularly aligning said handle member with said body member.

5. The fore end wrench as set forth in claim 3, further comprising:

said body member comprising a handle locking bore, said handle locking bore extending into said body member from said first end of said body member such that said handle locking bore intersects said handle bore; and a handle locking member being threadably insertable into said handle locking bore of said body member, said handle locking member being rotatable with respect to said body member for changing a linear orientation of said handle locking member in said handle bore of said body member, said handle locking member selectively abutting against said handle member for inhibiting removal of said handle member from said handle bore when said handle member is positioned in said handle bore of said body member, said handle locking member selectively disengaging said handle member for permitting removal of said handle member from said handle bore of said body member.

6. The fore end wrench as set forth in claim 5, wherein said handle locking bore has a longitudinal axis being substantially collinear with the longitudinal axis of said body member.

7. The fore end wrench as set forth in claim 1, wherein said receiving bore of said body member comprises a longitudinal axis being substantially perpendicular to the longitudinal axis of said body member such that said receiving bore is for perpendicularly aligning said engagement member with said body member for proper insertion of said engagement member into the channels of the locking nut of the shotgun.

8. The fore end wrench as set forth in claim 7, further comprising:

said body member comprising an engagement locking bore, said engagement locking bore extending into said body member from a second end of said body member such that said engagement locking bore intersects said engagement bore; and an engagement locking member being threadably insertable into said engagement locking bore of said body member, said engagement locking member being rotatable with respect to said body member for changing a linear orientation of said engagement locking member in said engagement bore of said body member, said engagement locking member selectively abutting against said engagement member for inhibiting removal of said engagement member from said engagement bore when said engagement member is positioned in said engagement bore of said body member, said engagement locking member selectively disengaging said engagement member for permitting removal of said engagement member from said engagement bore of said body member.

9. The fore end wrench as set forth in claim 8, wherein said engagement locking bore has a longitudinal axis being substantially collinear with the longitudinal axis of said body member.

10. The fore end wrench as set forth in claim 8, further comprising:

said body member comprising an insert bore, said insert bore extending through said body member, said insert bore selectively receiving an insert member such that said insert member is adapted for being inserted into the channels of the locking nut for facilitating rotation of the locking nut when said engagement member is removed from said receiving bore.

11. The fore end wrench as set forth in claim 10, wherein said insert bore of said body member comprises a longitudinal axis being substantially perpendicular to the longitudinal axis of said body member such that said receiving bore is for perpendicularly aligning said insert member with said body member for proper insertion of said insert member into the channels of the locking nut of the shotgun.

12. The fore end wrench as set forth in claim 10, wherein said insert bore is positioned substantially perpendicular to said receiving bore for maintaining a maximum amount of material of said body member between said receiving bore and said insert bore for inhibiting fracturing of the material of said body member between said receiving bore and said insert bore.

13. The fore end wrench as set forth in claim 10, wherein said engagement member has a diameter greater than a diameter of said insert member, said insert member being adapted for engaging channels of a locking nut of a shotgun narrower than the diameter of said engagement member for facilitating removal of the locking nut.

14. The fore end wrench as set forth in claim 10, wherein said insert bore intersects said engagement locking bore, said engagement locking member selectively abutting said insert member for inhibiting removal of said insert member from said insert bore when said engagement member is removed from said receiving bore.

15. The fore end wrench as set forth in claim 1, further comprising:

said body member comprising an insert bore, said insert bore extending through said body member, said insert bore selectively receiving an insert member such that said insert member is adapted for being inserted into the channels of the locking nut for facilitating rotation of the locking nut when said engagement member is removed from said receiving bore.

16. The fore end wrench as set forth in claim 15, wherein said insert bore of said body member comprises a longitudinal axis being substantially perpendicular to the longitudinal axis of said body member such that said receiving bore is for perpendicularly aligning said insert member with said body member for proper insertion of said insert member into the channels of the locking nut of the shotgun.

17. The fore end wrench as set forth in claim 15, wherein said insert bore is positioned substantially perpendicular to said receiving bore for maintaining a maximum amount of material of said body member between said receiving bore and said insert bore for inhibiting fracturing of the material of said body member between said receiving bore and said insert bore.

18. The fore end wrench as set forth in claim 15, wherein said engagement member has a diameter greater than a diameter of said insert member, said insert member being adapted for engaging channels of a locking nut of a shotgun narrower than the diameter of said engagement member for facilitating removal of the locking nut.

19. A fore end wrench for facilitating removal of the locking nut from a slide action of a pump shotgun to allow the slide to be removed from the shotgun, the fore end wrench comprising:

a body member being adapted for being inserted into the locking nut of the slide action of the shotgun, said body member being adapted for supporting the locking nut of the shotgun;

an engagement member extending through said body member, said engagement member being adapted for engaging channels of the locking nut such that rotation of said body member by a user rotates said engagement member against the locking nut for rotating the locking nut to remove the locking nut from the slide action to allow removal of the slide from the slide action;

a handle member extending through said body member, said handle member being positioned through said body member proximate a first end of said body member, said handle member comprising a longitudinal axis being substantially perpendicular to a longitudinal axis of said body member, said handle member being adapted for being engaged by a hand of the user for facilitating rotating of said body member;

said body member comprising a handle bore, said handle bore extending through said body member, said handle bore slidably receiving said handle member such that said handle member is selectively removable from said handle bore;

said handle bore of said body member comprising a longitudinal axis being substantially perpendicular to the longitudinal axis of said body member such that said handle bore is for perpendicularly aligning said handle member with said body member;

said body member comprising a handle locking bore, said handle locking bore extending into said body member from said first end of said body member such that said handle locking bore intersects said handle bore;

a handle locking member being threadably insertable into said handle locking bore of said body member, said handle locking member being rotatable with respect to said body member for changing a linear orientation of said handle locking member in said handle bore of said body member, said handle locking member selectively abutting against said handle member for inhibiting removal of said handle member from said handle bore when said handle member is positioned in said handle bore of said body member, said handle locking member selectively disengaging said handle member for permitting removal of said handle member from said handle bore of said body member;

said handle locking bore having a longitudinal axis being substantially collinear with the longitudinal axis of said body member;

said body member comprising a receiving bore, said receiving bore extending through said body member, said receiving bore slidably receiving said engagement member such that said engagement member is selectively removable from said receiving bore;

said receiving bore of said body member comprising a longitudinal axis being substantially perpendicular to the longitudinal axis of said body member such that said receiving bore is for perpendicularly aligning said engagement member with said body member for proper insertion of said engagement member into the channels of the locking nut of the shotgun;

said body member comprising an engagement locking bore, said engagement locking bore extending into said body member from a second end of said body member such that said engagement locking bore intersects said engagement bore;

an engagement locking member being threadably insertable into said engagement locking bore of said body member, said engagement locking member being rotatable with respect to said body member for changing a linear orientation of said engagement locking member in said engagement bore of said body member, said engagement locking member selectively abutting against said engagement member for inhibiting removal of said engagement member from said engagement bore when said engagement member is positioned in said engagement bore of said body member, said engagement locking member selectively disengaging said engagement member for permitting removal of said engagement member from said engagement bore of said body member;

said engagement locking bore having a longitudinal axis being substantially collinear with the longitudinal axis of said body member;

said body member comprising an insert bore, said insert bore extending through said body member, said insert bore selectively receiving an insert member such that said insert member is adapted for being inserted into the channels of the locking nut for facilitating rotation of the locking nut when said engagement member is removed from said receiving bore;

said insert bore of said body member comprising a longitudinal axis being substantially perpendicular to the longitudinal axis of said body member such that said receiving bore is for perpendicularly aligning said insert member with said body member for proper insertion of said insert member into the channels of the locking nut of the shotgun;

said insert bore being positioned substantially perpendicular to said receiving bore for maintaining a maximum amount of material of said body member between said receiving bore and said insert bore for inhibiting fracturing of the material of said body member between said receiving bore and said insert bore; said engagement member having a diameter greater than a diameter of said insert member, said insert member being adapted for engaging channels of a locking nut of a shotgun narrower than the diameter of said engagement member for facilitating removal of the locking nut; and said insert bore intersecting said engagement locking bore, said engagement locking member selectively abutting said insert member for inhibiting removal of said insert member from said insert bore when said engagement member is removed from said receiving bore.

20. A fore end wrench for facilitating removal of the locking nut from a slide action of a pump shotgun to allow the slide to be removed from the shotgun, the fore end wrench comprising:

a body member being adapted for being inserted into the locking nut of the slide action of the shotgun, said body member being adapted for supporting the locking nut of the shotgun;

an engagement member extending through said body member, said engagement member being adapted for engaging channels of the locking nut such that rotation of said body member by a user rotates said engagement member against the locking nut for rotating the locking nut to remove the locking nut from the slide action to allow removal of the slide from the slide action;

a handle member extending through said body member, said handle member being positioned through said body member proximate a first end of said body member, said handle member comprising a longitudinal axis being substantially perpendicular to a longitudinal axis of said body member, said handle member being adapted for being engaged by a hand of the user for facilitating rotating of said body member;

said body member comprising a handle bore, said handle bore extending through said body member, said handle bore slidably receiving said handle member such that said handle member is selectively removable from said handle bore;

said body member comprising a handle locking bore, said handle locking bore extending into said body member from said first end of said body member such that said handle locking bore intersects said handle bore; and a handle locking member being threadably insertable into said handle locking bore of said body member, said handle locking member being rotatable with respect to said body member for changing a linear orientation of said handle locking member in said handle bore of said body member, said handle locking member selectively abutting against said handle member for inhibiting removal of said handle member from said handle bore when said handle member is positioned in said handle bore of said body member, said handle locking member selectively disengaging said handle member for permitting removal of said handle member from said handle bore of said body member.

* * * * *